US012745853B2

(12) United States Patent
Kehoe

(10) Patent No.: US 12,745,853 B2
(45) Date of Patent: Sep. 29, 2026

(54) ADJUSTABLE PILLOW SET

(71) Applicant: Jill Kehoe, Camarillo, CA (US)

(72) Inventor: Jill Kehoe, Camarillo, CA (US)

( * ) Notice: Subject to any disclaimer, the term of this patent is extended or adjusted under 35 U.S.C. 154(b) by 112 days.

(21) Appl. No.: 18/798,817

(22) Filed: Aug. 9, 2024

(65) Prior Publication Data

US 2026/0041248 A1 Feb. 12, 2026

(51) Int. Cl.
*A47C 20/02* (2006.01)
*A47D 13/08* (2006.01)

(52) U.S. Cl.
CPC ..... *A47C 20/027* (2013.01); *A47C 20/023* (2013.01); *A47D 13/083* (2013.01)

(58) Field of Classification Search
CPC ... A47D 13/083; A47D 20/027; A47D 20/023
USPC ..... 5/655, 646, 632, 636, 652, 657
See application file for complete search history.

(56) References Cited

U.S. PATENT DOCUMENTS

| | | | | |
|---|---|---|---|---|
| 9,138,072 | B1 * | 9/2015 | Sanders | A47G 9/0253 |
| 9,232,863 | B1 * | 1/2016 | Zenoff | A47D 13/083 |
| 12,402,732 | B2 * | 9/2025 | Kaufman | A47C 7/425 |
| 2005/0235425 | A1 * | 10/2005 | Parrilla | A47D 13/08 5/655 |
| 2006/0162080 | A1 * | 7/2006 | Littlehorn | A47D 13/083 5/655 |
| 2011/0119833 | A1 * | 5/2011 | Clark | A47D 13/083 5/655 |
| 2013/0047341 | A1 * | 2/2013 | Currier | B60R 22/105 5/652 |
| 2013/0139320 | A1 * | 6/2013 | Tzameret | A47D 13/083 5/632 |
| 2015/0196136 | A1 * | 7/2015 | Riddick | A47D 13/083 5/655 |

* cited by examiner

*Primary Examiner* — J. T. Newton

(57) ABSTRACT

A breastfeeding pillow set, comprising an arm pillow, a front pillow, a back pillow and fasteners attaching the front pillow to the arm pillow, and the back pillow to the arm pillow. The front pillow attaches to the arm pillow at a position that is adjustable along a length of the arm pillow. Attaching the front pillow, the arm pillow, and the back pillow to each other forms an opening that fits around a torso of a person. The opening has a width between the front pillow and the back pillow that is adjustable.

11 Claims, 7 Drawing Sheets

ADJUSTABLE PILLOW SET

BACKGROUND OF THE INVENTION

This disclosure relates to an adjustable pillow set that may provide support for the back, neck and arms of a person breastfeeding an infant.

SUMMARY OF THE INVENTION

Embodiments are directed to a breastfeeding pillow set that adjustably provide support for the infant, the mother's arms and back. The pillows attach to each other and form an opening that wraps around the mother's torso. By adjusting the attachment of the pillows, the opening, height, and support may be adjusted to accommodate different body types and nursing positions.

In an embodiment, a breastfeeding pillow set may include an arm pillow, a front pillow, a back pillow, and fasteners attaching the front pillow to the arm pillow, and the back pillow to the arm pillow. The front pillow may attach to the arm pillow at a position that is adjustable along a length of the arm pillow. Attaching the front pillow, the arm pillow, and the back pillow to each other may form an opening that fits around a torso of a person. The opening may have a width between the front pillow and the back pillow that is adjustable.

The breastfeeding pillow set may include a neck cushion that attaches to the back pillow.

A side of the front pillow, a side of the arm pillow, and a side of the back pillow facing each other may form an inner surface of the opening. A portion of the inner surface may be in contact with the torso of the person. A portion of the inner surface may include a smooth material.

The front pillow may have a hexahedron shape. An area of a top surface of the hexahedron shape may be larger than an area of a bottom surface of the hexahedron shape. The difference in the areas may form a beveled side of the front pillow towards the torso of the person.

The fasteners may include hook and loop fasteners that attach to each other.

The front pillow may include a flap that extends from the front pillow. The flap may at least partially wrap the arm pillow.

The breastfeeding pillow set may include a back supporter connecting to the arm pillow and to the back pillow. The back supporter may include a tensioner that adjusts a pressure of the back pillow against the back of the torso of the person.

The back supporter may include a strap attached to a rear side of the back pillow. The strap may extend to the arm pillow, The tensioner of the back supporter may include a hook and loop fastener attaching a section of the strap to the arm pillow. The tensioner may adjust the pressure by tightening the strap. The strap may be tightened by pulling the strap and adjusting the position that the section of the strap attaches to the arm pillow.

The breastfeeding pillow set may include a head supporter. The head supporter may include a second strap attached to the rear side of the back pillow. The second strap may extend to the arm pillow. The second strap maybe attached to a higher position on the rear side of the back pillow than the strap of the back supporter.

The breastfeeding pillow set may include a stackable height adjustment pillow that may attach to at least one bottom portion of the front pillow, the arm pillow, or the back pillow. The stackable height adjustment pillow may attach to another stackable height adjustment pillow.

The stackable height adjustment pillow may include laces that attach the stackable height adjustment pillow to the bottom portion of the front pillow, the arm pillow, or the back pillow, or to another stackable height adjustment pillow.

DETAILED DESCRIPTION

Figure 1:
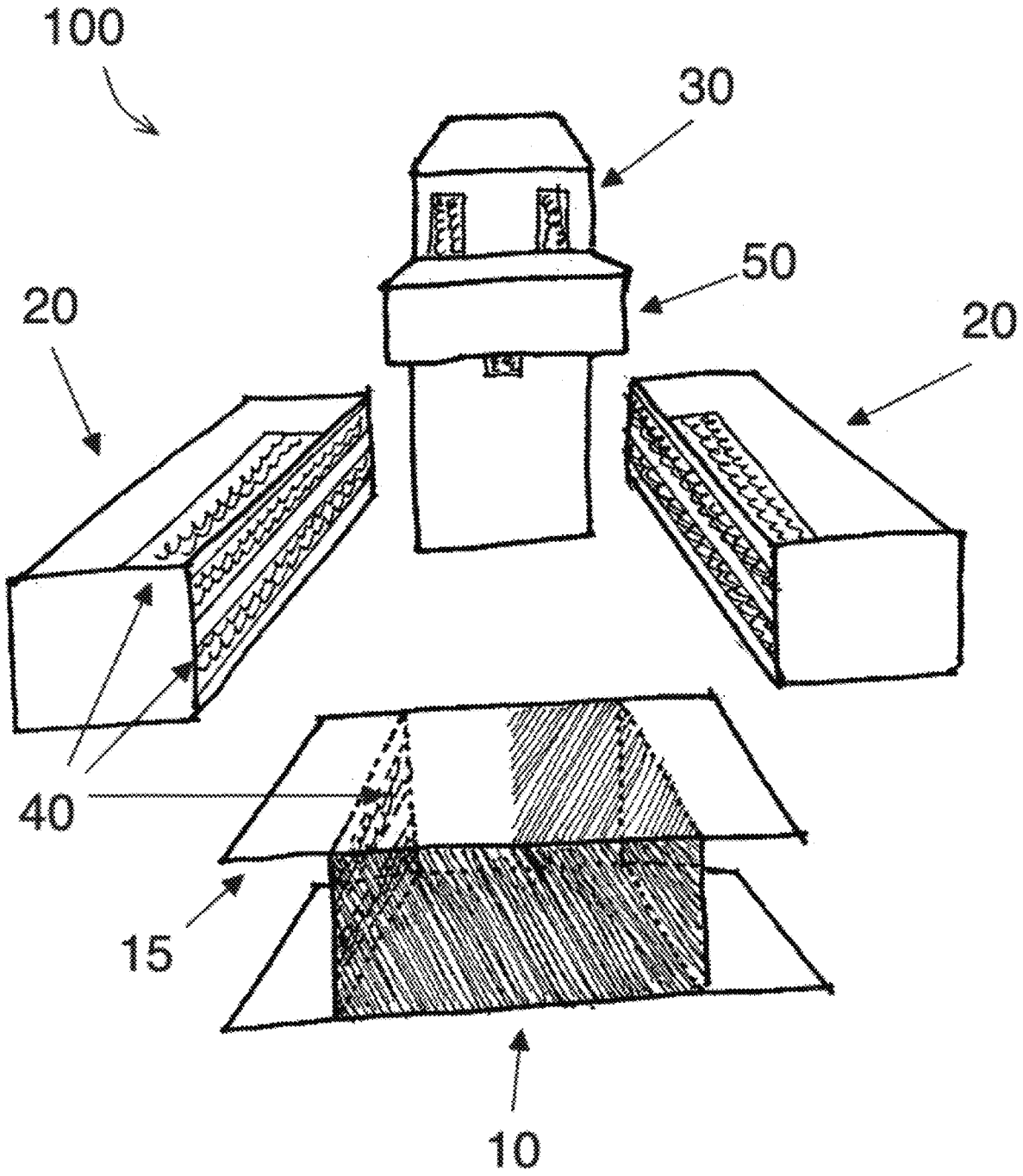
FIG. 1 shows an exploded view of the components of a breastfeeding pillow set according to an embodiment.

The disclosure will now be described more fully hereinafter with reference to the accompanying drawings, in which embodiments are shown. This disclosure may, however, be embodied in different forms and should not be construed as limited to the embodiments set forth herein. Rather, these embodiments are provided so that this disclosure will be thorough and complete, and will fully convey the scope of the disclosure to those skilled in the art.

Like components will be designated by like reference symbols. Furthermore, it should be noted that the drawings may be exaggerated in thickness, ratio, and dimension of components for descriptive convenience and clarity only. The term "and/or" includes all combinations of one or more of the associated listed items.

It will be understood that, although the terms "first," "second," etc. may be used herein to describe various elements, these elements should not be limited by these terms. These terms are only used to distinguish one element from another element. For instance, a first element discussed below could be termed a second element without departing from the teachings of the disclosure. Similarly, the second element could also be termed the first element. In the specification and the claims, the singular forms are intended to include the plural forms as well, unless the context clearly indicates otherwise.

Also, the terms "under," "below," "above," "upper," and the like are used herein for explaining relationship between one or more components illustrated in the drawings. These terms may be relative terms describing the positions of components in the drawings, but the positions of components are not limited thereto.

It will be further understood that the terms "comprise," "include," "have," etc. when used in this specification, specify the presence of stated features, integers, steps, operations, elements, components, and/or combinations of them but do not preclude the presence or addition of one or more other features, integers, steps, operations, elements, components, and/or combinations thereof.

As used herein, the singular forms, "a," "an," and "the" are intended to include the plural forms as well, unless the context clearly indicates otherwise.

In the specification and the claims, the phrase "at least one of" is intended to include the meaning of "at least one selected from the group of" for the purpose of its meaning and interpretation. For example, "at least one of A and B" may be understood to mean "A, B, or A and B."

The terms "overlap" or "overlapped" mean that a first object may be above or below or to a side of a second object, and vice versa. Additionally, the term "overlap" may include layer, stack, face or facing, extending over, covering, or partly covering or any other suitable term as would be appreciated and understood by those of ordinary skill in the art.

The phrase "in a plan view" means viewing the object from the top, and the phrase "in a schematic cross-sectional view" means viewing a cross-section of which the object is vertically cut from the side.

About" or "approximately" as used herein is inclusive of the stated value and means within an acceptable range of deviation for the value as determined by one of ordinary skill in the art, considering the measurement in question and the error associated with measurement of the quantity (i.e., the limitations of the measurement system). For example, "about" may mean within one or more standard deviations, or within ¬±30%, 20%, 10%, 5% of the stated value.

It will be understood that when an element (or a region, a layer, a portion, or the like) is referred to as "being on", "connected to" or "coupled to" another element in the specification, it can be directly disposed on, connected or coupled to another element mentioned above, or intervening elements may be disposed therebetween.

Figure 2:
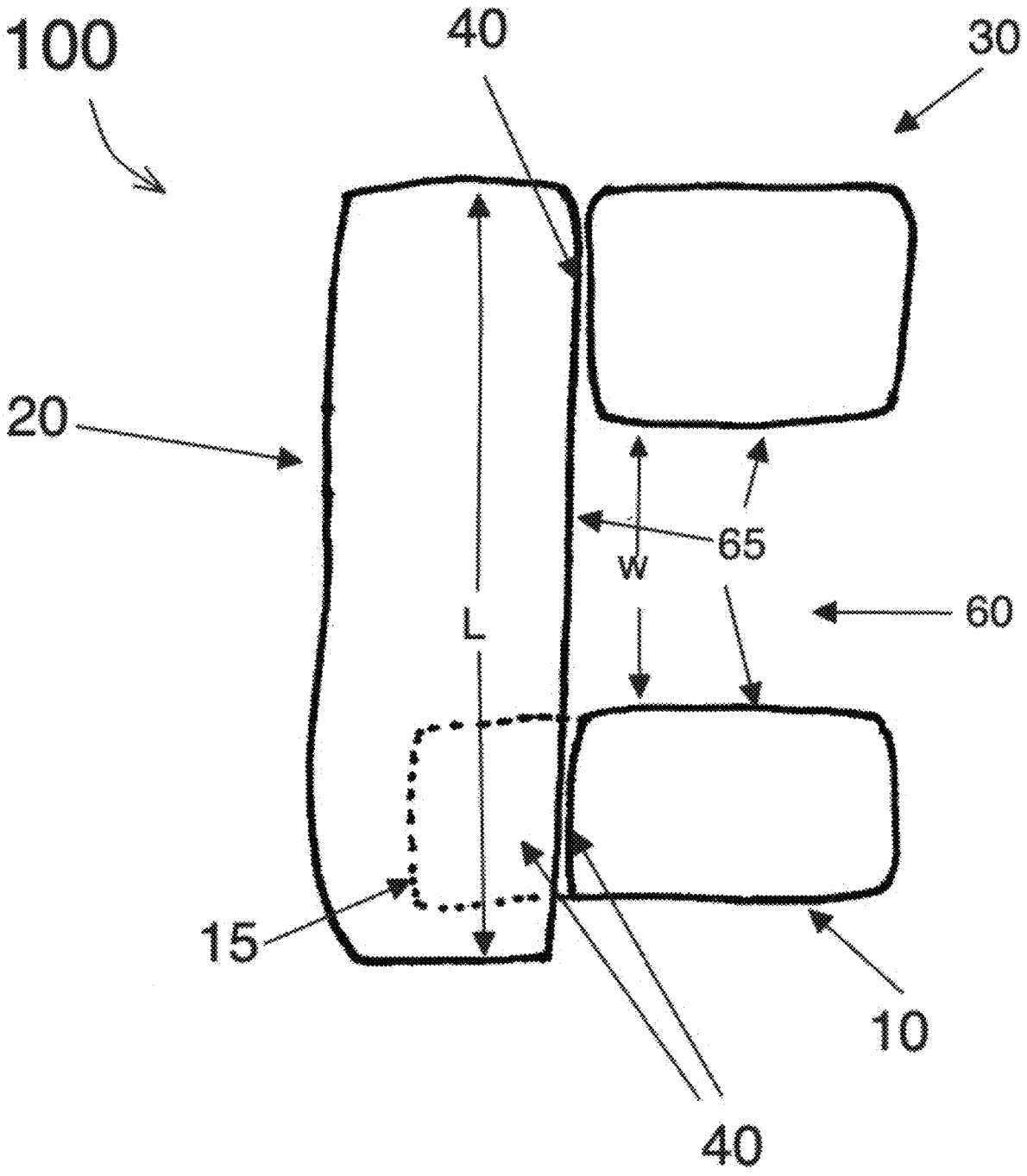
FIG. 2 illustrates a plan view of the main pillows (the front pillow, the arm pillow, and the back pillow) of the breastfeeding pillow set described in FIG. 1 attached to each other.
Figure 3:
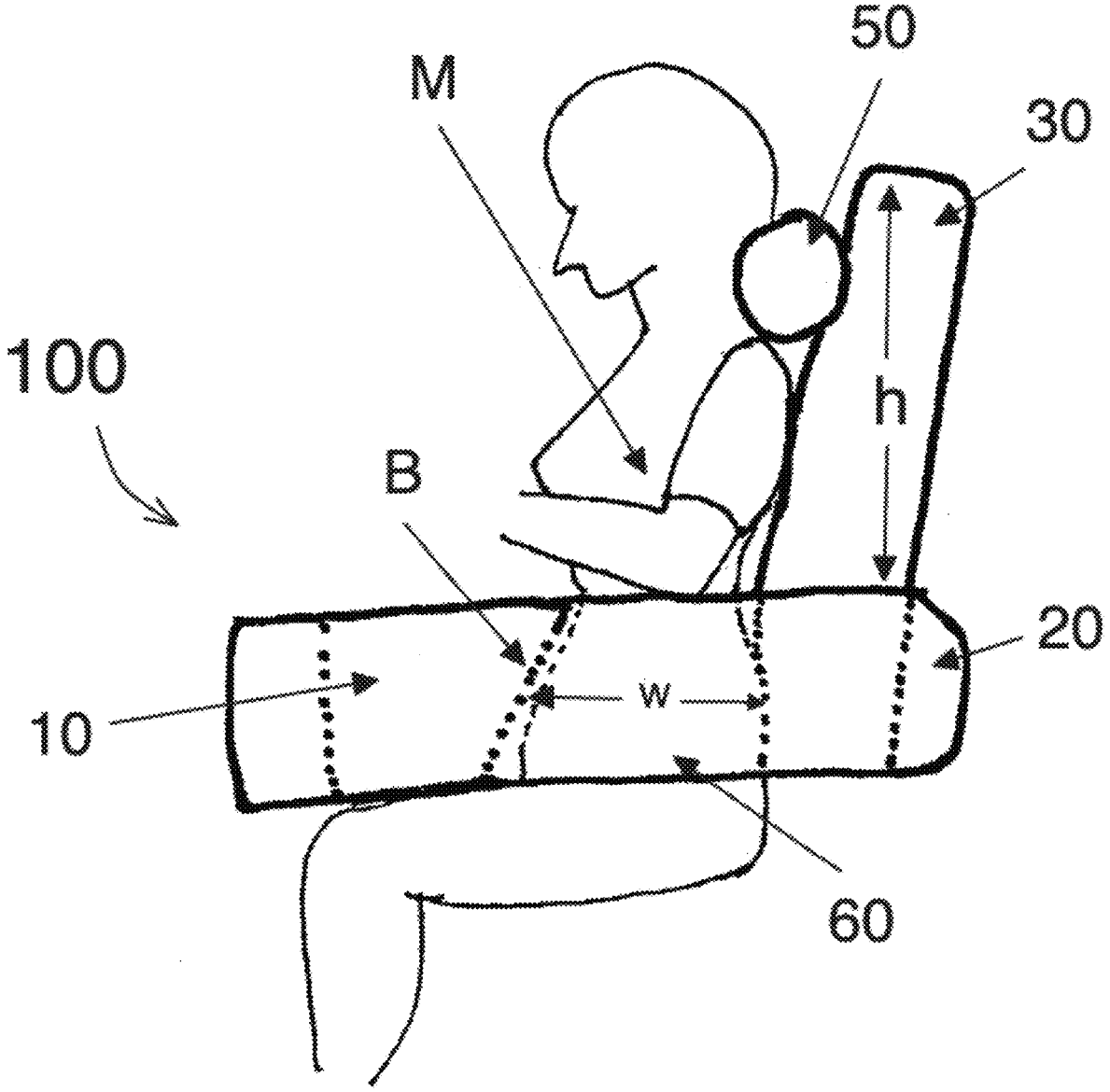
FIG. 3 illustrates a mother sitting with the breastfeeding pillow set around her torso.
Figure 4:
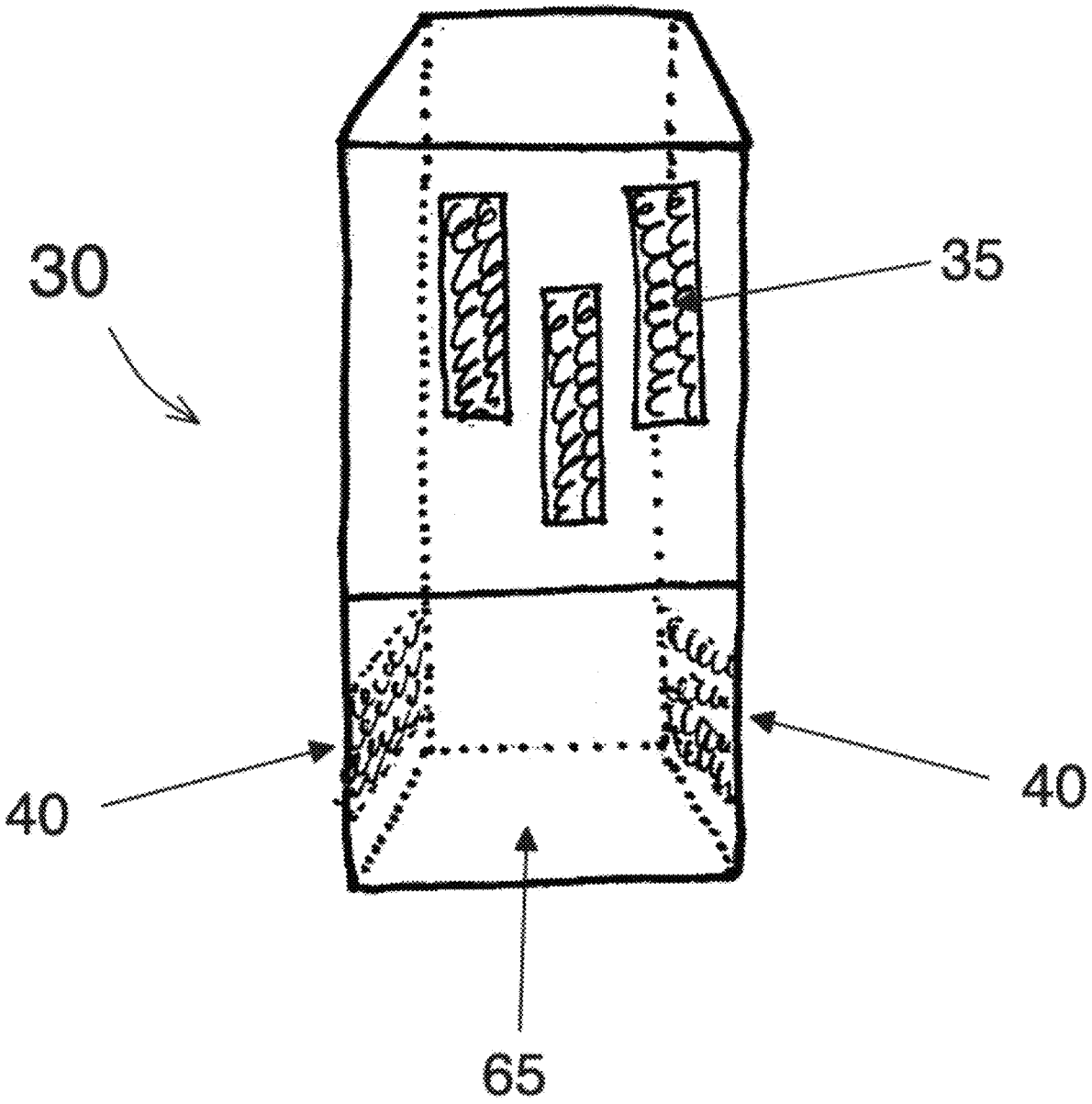
FIG. 4 illustrates details of the back pillow.

FIG. 1 shows an exploded view of the components of an embodiment. FIG. 2 illustrates a plan view of the main pillows (the front pillow, the arm pillow, and the back pillow) of the breastfeeding pillow set described in FIG. 1 attached to each other. FIG. 3 illustrates a mother sitting with the breastfeeding pillow set around her torso. FIG. 4 illustrates details of the back pillow.

FIG. 1 illustrates an embodiment of a breastfeeding pillow set 100. A front pillow 10 may be positioned on the lap of the person feeding the baby and may support the baby. This is useful for a mother who is breastfeeding. A back pillow 30 may support the back of the mother. Fasteners 40 may attach the front pillow 10, the arm pillow 20 and back pillow 30 to each other. The front pillow 10, the arm pillows 20, and the back pillow 30 may comprise the main pillows of the pillow set.

FIG. 2 illustrates how the front pillow 10, the back pillow 30, and an arm pillow 20 of FIG. 1 form an opening 60 that fits around a torso of a person (the mother who is breastfeeding her infant). The fasteners 40 may attach the front pillow 10 to the arm pillow 10. The fasteners may also attach the back pillow 30 to the arm pillow. The width w of the opening between the front pillow 10 and back pillow 30 may be adjustable by moving the location along the length L of the arm pillow 20 where the front pillow 10 is attached.

In the embodiments, the pillow set may further comprise a neck cushion 50 (refer to FIG. 1) that attaches to the back pillow 30. The neck cushion 50 may provide further support for the neck while breastfeeding.

FIG. 3 illustrates a side view of the mother M sitting with the pillow set 100 around her torso which also includes a neck cushion 50. The mother M may adjust the fit of the pillows and the support they provide and improve comfort while breastfeeding the baby. Once the pillow set 100 is configured, the mother M can slide the pillows down and step out after finishing breastfeeding session. The pillow configuration remains the same for subsequent sessions.

For subsequent breastfeeding sessions, the mother M can wear the configured pillow set by slipping her head and arms into the opening 60 from the bottom of the pillow set 100 and then push the pillow set 100 down to fit around her torso. The mother M can use her arms to lift the baby with the pillow set fitted around her torso. After finding a comfortable seating position, she can place the baby on the front pillow 10 and then begin feeding the infant.

In the embodiments of FIG. 2, an inner surface of the opening 60 is formed by sides of the front pillow, arm pillow, and the back pillow. The inner surface of the opening may include a smooth material 65. The smooth material 65, which may be on the side of the pillows that face the person, facilitates sliding the configured pillow set along the body of the mother when she wears the pillow set and steps out of the pillow set. The smooth material 65 may include any fabric with low friction such as silk or synthetic fabrics.

FIG. 3 illustrates an embodiment where the front pillow may have a hexahedron shape where the side facing towards the torso has a beveled shape B. The area of the top surface of the hexahedron shape may be larger than the area of the bottom surface. The beveled shape may conform the front pillow to the shape of the sitting person's belly.

The fasteners 40 in the embodiments illustrated in FIGS. 1 and 2 may comprise hook and loop fasteners that attach to each other. For example, the fasteners 40 may comprise VELCRO® fasteners that attach to each other. FIG. 1 shows the fasteners 40 extending along the length L of the arm pillow 20 on the inner side of the arm pillow 20. Corresponding fasteners 40 on the sides of front pillow 10 that may contact the fasteners 40 on the inner side of the arm pillow 20 may secure the front pillow 10.

The fasteners 40 are not limited to such hook and loop fasteners. Other fabric fasteners such as snap buttons, laces, straps and buckles, that allow the front pillow to be attached at a position that is adjustable attached along the length of the arm pillow may also be used. FIGS. 1 and 2 illustrate an example where VELCRO® fasteners 40 are disposed on the sides and top of the arm pillow 20, a side of the front pillow 10, and a side of the back pillow 20. On the side of the arm pillow 20, the smoother loop side of VELCRO® strips may be placed on the smooth material 65 (refer to FIG. 2).

In other embodiments, the fasteners may include rigid members on the bottom portions of the pillow of that may be coupled to each other to attach the pillows. The rigid members may form a frame when attached to each other and may provide additional support for the pillows.

In the embodiments, the front pillow may further comprise a flap 15 (refer to FIGS. 1 and 2) that extends from the front pillow and at least partially wraps the arm pillow. FIG. 1. illustrates flaps 15 on the front pillow. The dotted lines of FIG. 2 illustrate flap 15, which may include corresponding VELCRO® fastener on a side of the flap that contacts the arm pillow 20. Such a flap 15 may attach to the VELCRO® fastener 40 on the top surface of the arm pillow 20 shown in FIG. 1. In the embodiment illustrated in FIG. 1, a bottom flap extends from the bottom of the front pillow. This bottom may wrap the bottom side of arm pillow 20 and attach to additional VELCRO fasteners on the bottom surface of the arm pillow 20.

FIG. 4 illustrates details of the back pillow 30 described in FIGS. 1-3. The back pillow side facing the back of the mother may include VELCRO® fasteners 35 for attaching a neck cushion 50 (refer to FIGS. 1 and 3). The VELCRO® fasteners 40 on the sides may attach the back pillow 30 to the arm pillow 20 (refer to FIG. 1-3).

Referring to FIG. 3 and to FIG. 4, the height h, extending from the arm pillow to the top of the back pillow 30 relative to the mother's back, may be adjusted by changing the vertical location where the VELCRO® fasteners 40 of the back pillow 30 attaches to the arm pillow 20. In this way, the mother can adjust the fit of the back pillow and her back to provide comfortable support.

The lower portion of the back pillow facing the back may form part of the inner surface of the opening 60 (refer to FIG. 2) and may include the smooth material 65.

Figure 5:
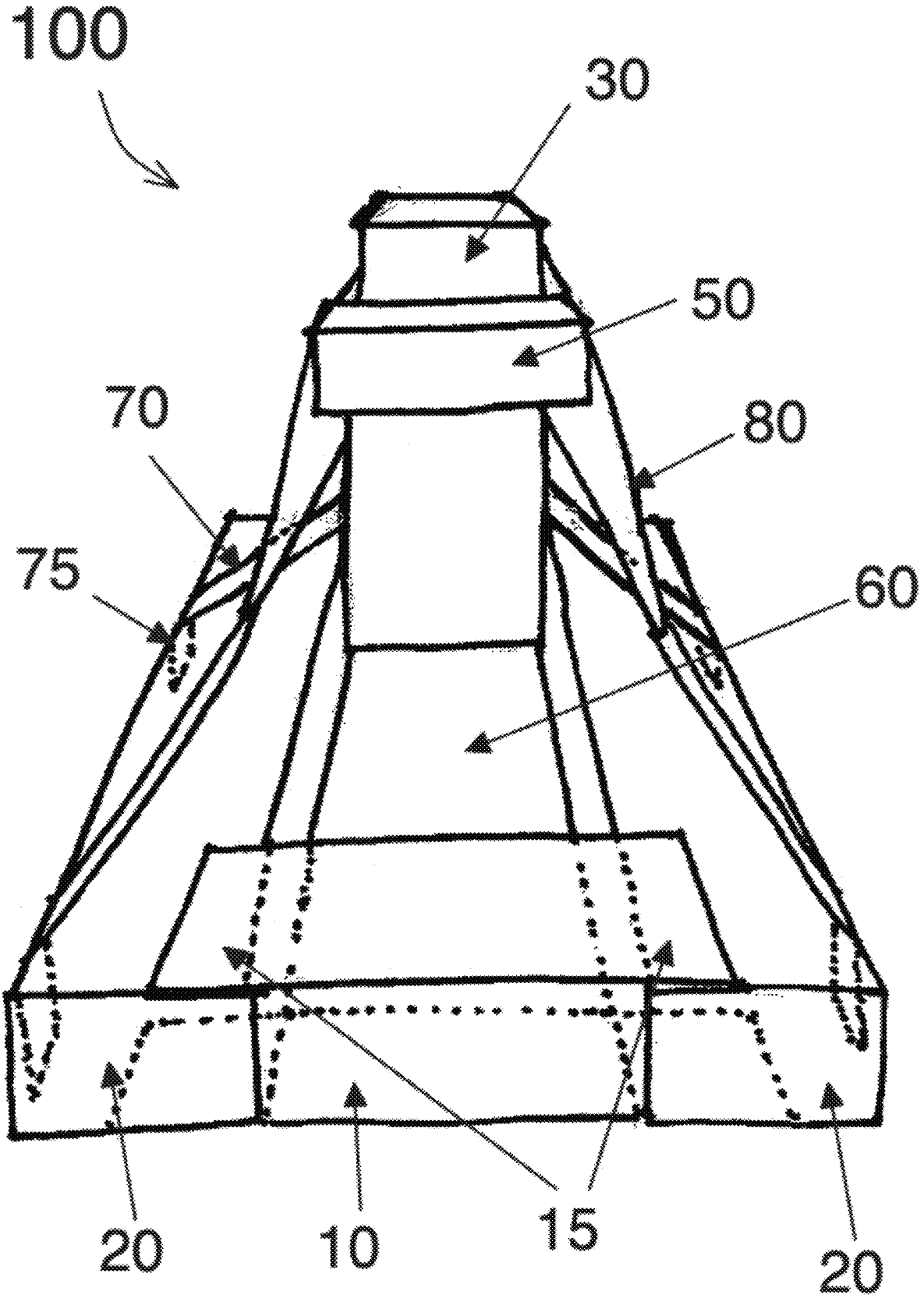
FIG. 5 illustrates the fully assembled pillow set with a back supporter, and a head supporter.

FIG. 5 illustrates a fully assembled pillow set 100 from the components in FIG. 1 where the front pillow 10 (with flaps 15), the arm pillow 20, and the back pillow 30 are attached to each other. The attached pillows may form an opening 60 where the mother may sit. A neck cushion 50 is attached to the back pillow 30. The fasteners shown in FIG. 1 have been omitted.

The pillow set 100 in the embodiments of FIG. 5 may further include a back supporter 70 connecting to the arm pillow and to the back pillow. The back supporter may include a tensioner 75 that adjusts the pressure of the back pillow against the torso of the person sitting in the opening of the pillow.

The back supporter 70 in FIG. 5 may comprise a strap extending from the rear side of the back pillow to the arm pillow. The tensioner 75 may increase the pressure of the back pillow against the torso by tightening the strap. The tensioner 75 may comprise a hook and loop fastener (for example, a VELCRO® fastener) that attaches a section of the strap 70 to an outer side of the arm pillow 20. A VELCRO® fastener may run along the length of the arm pillow 20 on the outer side, like the fastener 40 illustrated in FIGS. 1 and 2. The strap 70 may be tightened by pulling the strap 70 and adjusting the position that the section of the strap 70 attaches to the arm pillow 20.

The pillow set in FIG. 5. may also include a head supporter 80. The head supporter 80 may be comprised of a second strap 80 extending from the rear side of the back pillow 30 to the arm pillow 20. The second strap 80 may be attached to a higher position on the rear side of the back pillow than the strap of the back supporter 70. The head supporter 80 may be attached to the arm pillow with VELCRO® fasteners in a similar manner as the back supporter.

Figure 6:
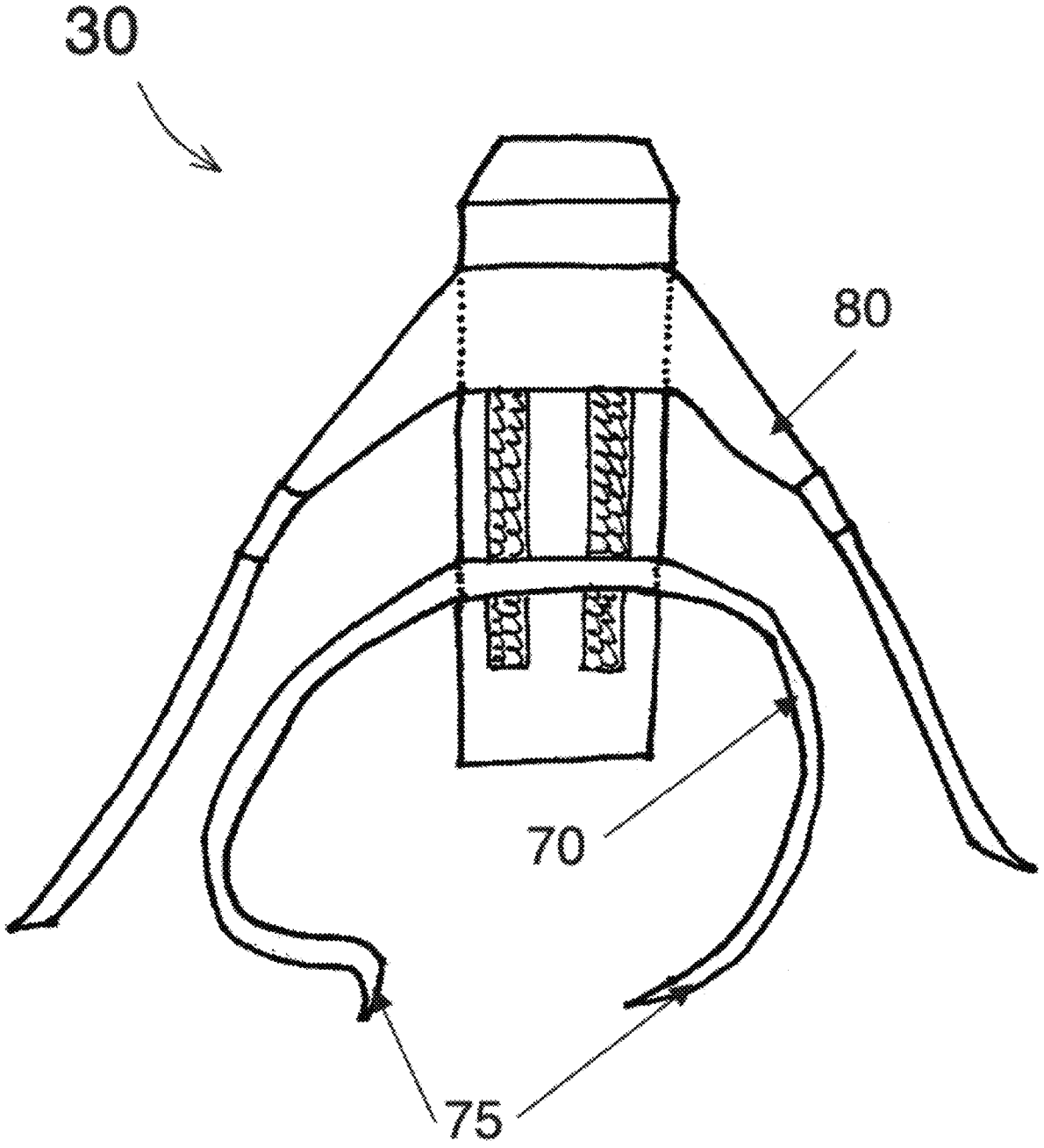
FIG. 6. illustrates the rear view of the back pillow with the back supporter and head supporter attached to the rear side.

FIG. 6. illustrates the rear view of the back pillow. Embodiments, as illustrated in FIG. 6, may attach the straps of back supporter 70 and the head supporter 80 to the arm pillow 20 using a VELCRO® fastener, but other fastening means may also be used. The tensioner illustrated in FIGS. 5 and 6 comprise VELCRO® fasteners that adjust the tightness of the back supporter strap 70 by the pulling the strap and attaching it to the arm pillow 20, but other embodiments may adjust the tightness of the strap with buckles.

Other embodiments of the back supporter may comprise a rigid member that is attached to the sides of arm pillows 20 and the rear surface of the back pillow 30 rather than straps. The back supporter may form a clamp that secures the arm pillow and back pillow. The tensioner may be a mechanism that presses a rigid plate into the back pillow, and thereby adjust the firmness.

Figure 7:
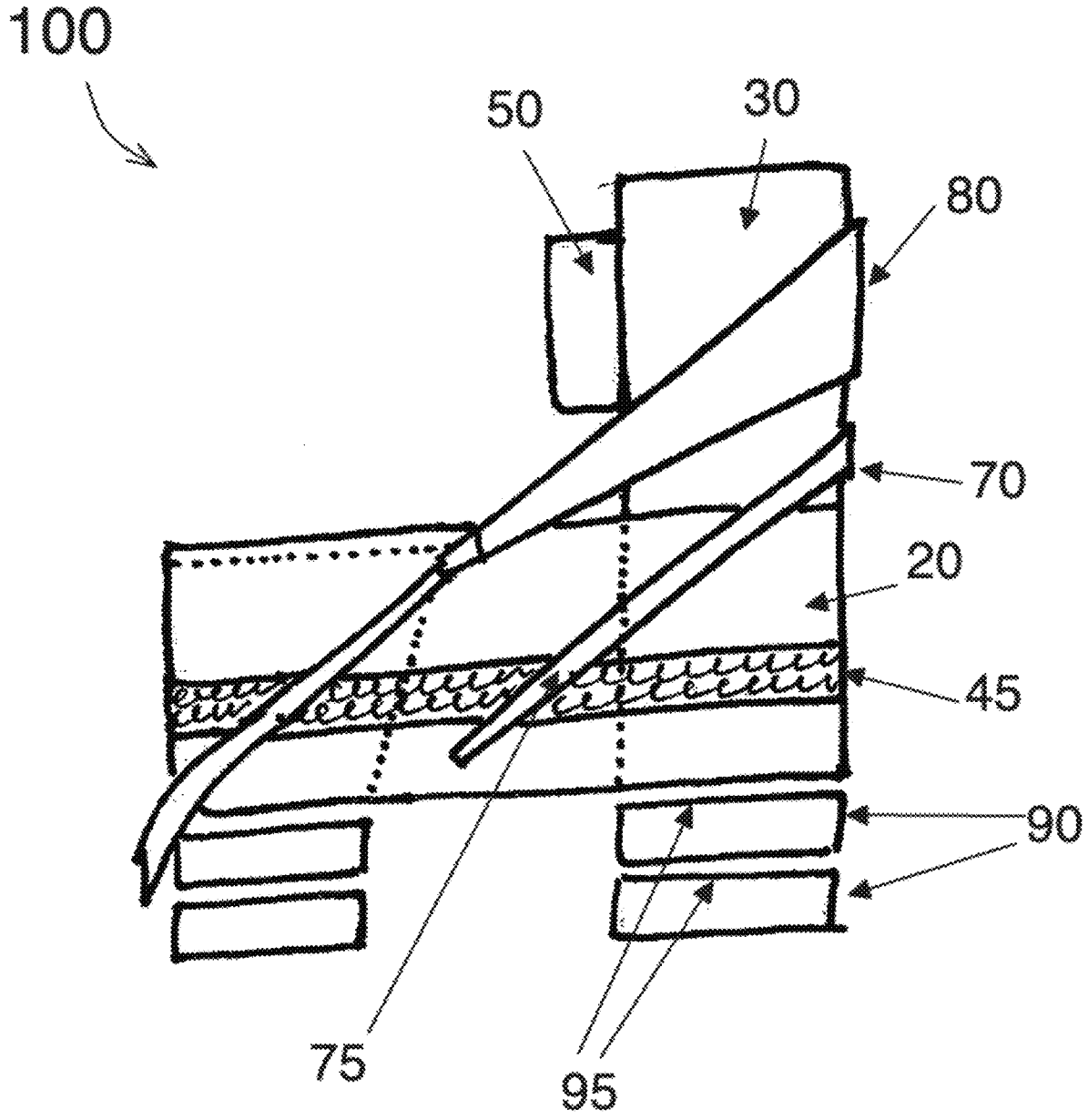
FIG. 7 illustrates a breastfeeding pillow set with stackable height adjustment pillows.

In the embodiments illustrated in FIG. 7, the pillow set 100 in FIG. 5 is shown from a left side view. The tensioner 75 of the back supporter strap 70 attaches to VELCRO® on the outer left side surface to secure the strap 70 and adjust pressure against the back pillow.

The pillow set 100 may include a stackable height adjustment pillow 90 that attaches to at least one bottom portion of the main pillows (the front pillow, the arm pillow, or the back pillow). The stackable height adjustment pillow may also attach to another stackable height adjustment pillow 90. The stackable height adjustment pillows may allow the mother to adjust the pillow set to a comfortable height for breastfeeding.

In the embodiments, the stackable height adjustment pillow may include laces 95 that attach it to the bottom portions of the front pillow, the arm pillow, or the back pillow. The laces 95 may also attach the stackable height adjustment pillow to another stackable height adjustment pillow. Detailed drawings of the laces 95 were omitted in FIG. 7.

Other embodiments may use other fastening means to attach the stackable height adjustment pillows. For example, hook and loop fabric fasteners (VELCRO® fasteners), or snappable buttons, may be used to attach the stackable height adjustment pillow to the main pillows or to each other.

Embodiments have been disclosed herein, and although terms are employed, they are used and are to be interpreted in a generic and descriptive sense only and not for purpose of limitation. In some instances, as would be apparent by one of ordinary skill in the art, features, characteristics, and/or elements described in connection with an embodiment may be used singly or in combination with features, characteristics, and/or elements described in connection with other embodiments unless otherwise specifically indicated. Accordingly, it will be understood by those of ordinary skill in the art that various changes in form and details may be made without departing from the spirit and scope of the disclosure as set forth in the following claims.

The invention claimed is:

1. A breastfeeding pillow set, comprising:

an arm pillow;

a front pillow;

a back pillow; and fasteners attaching the front pillow to the arm pillow, and the back pillow to the arm pillow;

wherein the front pillow attaches to the arm pillow at a position that is adjustable along a length of the arm pillow;

wherein attaching the front pillow, the arm pillow, and the back pillow to each other forms an opening that fits around a torso of a person; and wherein the opening has a width between the front pillow and the back pillow that is adjustable.

2. The breastfeeding pillow set of claim 1, further comprising:

a neck cushion that attaches to the back pillow.

3. The breastfeeding pillow set of claim 1, wherein a side of the front pillow, a side of the arm pillow, and a side of the back pillow facing each other form an inner surface of the opening, a portion of the inner surface contacts with the torso of the person; and wherein a portion of the inner surface includes a smooth material.

4. The breastfeeding pillow set of claim 1, wherein the front pillow has a hexahedron shape; and wherein an area of a top surface of the hexahedron shape is larger than an area of a bottom surface of the hexahedron shape, the difference in the areas forming a beveled side of the front pillow towards the torso of the person.

5. The breastfeeding pillow set of claim 1, wherein the fasteners comprise hook and loop fasteners that attach to each other.

6. The breastfeeding pillow set of claim 1, the front pillow further comprising:

a flap that extends from the front pillow, the flap at least partially wrapping the arm pillow.

7. The breastfeeding pillow set of claim 1, further comprising:

a back supporter connecting to the arm pillow and to the back pillow, the back supporter comprising:

a tensioner that adjusts a pressure of the back pillow against the back of the torso of the person.

8. The breastfeeding pillow set of claim 7, the back supporter further comprising:

a strap attached to a rear side of the back pillow, the strap extending to the arm pillow;

wherein the tensioner of the back supporter comprises a hook and loop fastener attaching a section of the strap to the arm pillow; and wherein the tensioner adjusts the pressure by tightening the strap, and the strap is tightened by pulling the strap and adjusting the position that the section of the strap attaches to the arm pillow.

9. The breastfeeding pillow set of claim 8, further comprising:

a head supporter, comprising:

a second strap attached to the rear side of the back pillow, the second strap extending to the arm pillow;

wherein the second strap is attached to a higher position on the rear side of the back pillow than the strap of the back supporter.

10. The breastfeeding pillow set of claim 1, further comprising:

a stackable height adjustment pillow that attaches to at least one bottom portion of the front pillow, the arm pillow, or the back pillow, or attaches to another stackable height adjustment pillow.

11. The breastfeeding pillow set of claim 10, wherein the stackable height adjustment pillow comprises laces that attach the stackable height adjustment pillow to the bottom portion of the front pillow, the arm pillow, or the back pillow, or to another stackable height adjustment pillow.

* * * * *